US006883964B2

(12) United States Patent
Beaulieu

(10) Patent No.: US 6,883,964 B2
(45) Date of Patent: Apr. 26, 2005

(54) MULTIWALL PAPER BAG

(75) Inventor: Sylvain Beaulieu, Rock-Forest (CA)

(73) Assignee: Hood Packaging Corporation/Emballage Hood Corporation, Burlington (CA)

( * ) Notice: Subject to any disclaimer, the term of this patent is extended or adjusted under 35 U.S.C. 154(b) by 0 days.

(21) Appl. No.: 10/102,074

(22) Filed: Mar. 19, 2002

(65) Prior Publication Data

US 2003/0179960 A1 Sep. 25, 2003

(30) Foreign Application Priority Data

Feb. 12, 2002 (CA) ..... 2372052

(51) Int. Cl.[7] ..... B65D 30/26

(52) U.S. Cl. ..... 383/53; 383/101; 383/103; 383/109

(58) Field of Search ..... 383/44, 53, 101, 383/102, 103, 109, 116, 115, 45, 54, 113

(56) References Cited

U.S. PATENT DOCUMENTS 1,752,370 A * 4/1930 Cornell ..... 383/53
2,593,328 A * 4/1952 Meaker ..... 383/101
3,085,608 A * 4/1963 Mathues ..... 383/103
3,784,085 A * 1/1974 Kilgore ..... 383/113
3,989,182 A * 11/1976 Stearley ..... 383/45
4,008,850 A * 2/1977 Goodrich ..... 383/85
4,382,538 A * 5/1983 Wilharm ..... 383/54
4,470,153 A * 9/1984 Kenan ..... 383/101
5,405,561 A * 4/1995 Dais et al. ..... 264/40.1
5,493,844 A * 2/1996 Combrink ..... 53/410
5,988,881 A * 11/1999 Sutherland ..... 383/103
6,375,603 B1 * 4/2002 Yuasa et al. ..... 493/256

FOREIGN PATENT DOCUMENTS

CA 454045 * 1/1949

* cited by examiner

*Primary Examiner*—Joseph C. Merek
(74) *Attorney, Agent, or Firm*—Hodgson Russ LLP

(57) ABSTRACT

A multiwall paper bag for bulk material, especially particulate or powdered material, has an inner ply of a high performance kraft paper, an intermediate layer or ply of a thin polyethylene secured to the outer surface of the inner ply, and an outer ply of high performance kraft paper that is secured to the intermediate ply. At least one end of the bag is closed during initial formation of the bag. The other end can be left open for filling and subsequent closing, or it can be initially closed and provided with a filling valve. At least the intermediate ply, and preferably the inner ply as well, is microperforated for venting of air during filling. The intermediate ply is secured to the inner ply either by a plurality of longitudinally extending transversely space apart lines of adhesive or the securing adhesive is spread completely over the mating surfaces of the two plies.

6 Claims, 2 Drawing Sheets

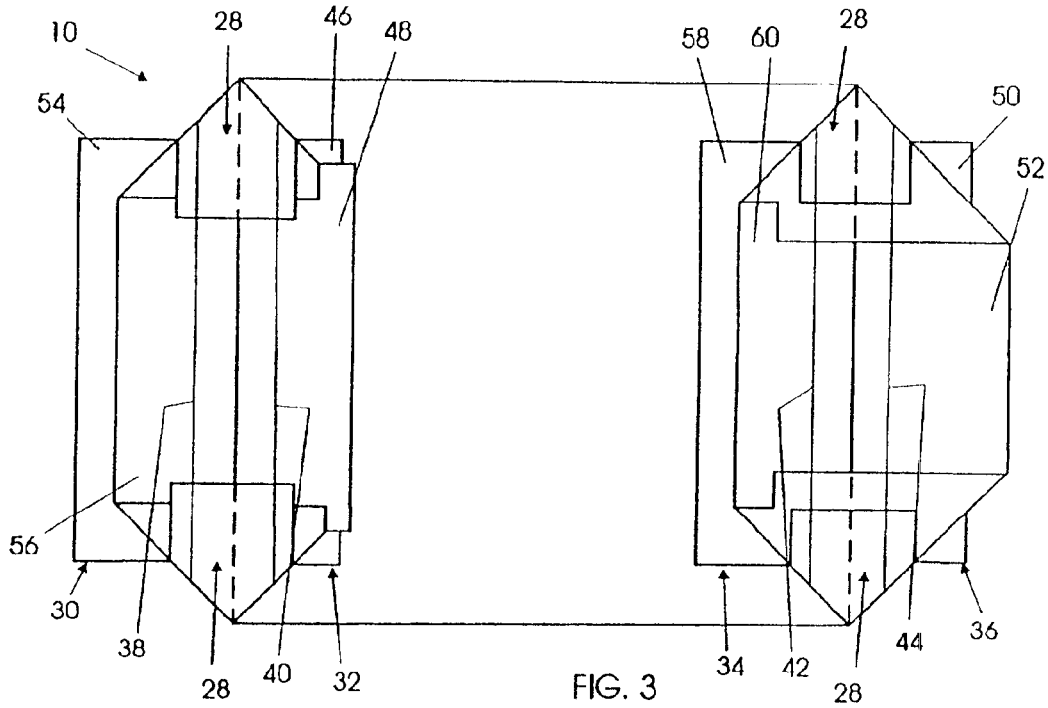
FIG. 3
FIG. 4
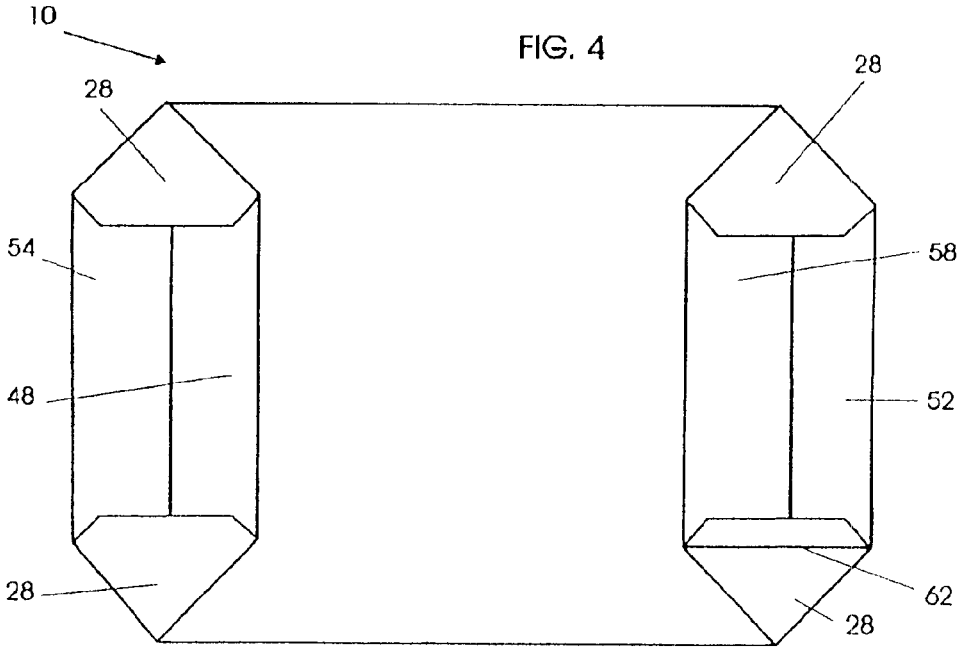

MULTIWALL PAPER BAG

The present invention relates in general to industrial bags used primarily for shipping and storage of bulk material and in particular to a new multiwall paper bag provided with an intermediate layer or ply of a protective plastics material.

BACKGROUND OF THE INVENTION

Multiwall stepped-end paper bags are well-known and have been used for many years for the shipping and storage of bulk materials, including fine powdery material or coarser particulate material. Such bags may be required to hold material weighing in the range of 10–50 kg. Typically such bags have an inner ply and an outer ply and may include one or more intermediate plies, depending on the strength required and the nature of the material to be carried. In some cases the intermediate ply will be of sheeting and the outer ply of a paper. Such bags require a paper patch to help strengthen the bottom of the bag, a time consuming process at the bottomer. Another form of bag uses a paper ply which is pre-coated with a polyethylene resin to provide interior protection. This type of bag is not competitively priced unless the supplier of the bag material has its own coater. Yet another style of bag has a plastics sheet or film adhered to the inner surface of a paper ply with an outer paper ply adhered to the first-mentioned paper ply. With this type of bag the plastics sheeting is in direct contact with the product being carried in the bag, and this may not be very desirable, especially for consumables. This configuration could lead to condensation within the bag. Also the inner ply of plastics material is at risk from scratching during forming of the bag itself and such scratching could destroy or adversely affect the barrier properties of the material. Still another style of bag, actually the most common in North America, uses three plies of paper with a plastics material film or ply sandwiched between the intermediate and inner paper plies. Such a design uses thin paper plies and needs the three plies of paper in order to ensure an adequately strong bottom. Also a three-paper ply bag is limited in basis weight reduction and is not competitively priced with bags that can be formed with fewer plies.

SUMMARY OF THE INVENTION

The present invention on the other hand realizes the savings that can be achieved with fewer plies of paper while maintaining the barrier protection properties achievable with a thin film of polyethylene that is not in contact with the contents of the bag. With the present invention an inner layer or ply of kraft paper, preferably a high performance paper, is provided with a thin layer or ply of polyethylene that is adhered to the outer surface thereof. An outer layer of kraft paper, preferably a high performance paper is in turn adhered to the outer surface of the intermediate ply of polyethylene. The bag material can be formed continuously and then cut to the desired length for each bag. This bag blank then passes to a stepped-end-bottom former which forms the stepped ends of the bag, with one end thereof being provided with an integral filling valve, as is known in the art.

Preferably the intermediate polyethylene ply is microperforated for breathing purposes. It is secured to the inner ply either over the entire surface or along a plurality of transversely spaced apart securement lines which extend longitudinally of the inner and intermediate plies. Securement can be achieved by the application of a suitable adhesive over the surface of the inner ply or along the securement lines. The inner ply can also be microperforated if desired. The outer ply should not be perforated in order to preserve the paper strength and to also ensure a cleaner filling procedure, especially with finely powdered material.

Generally speaking therefore, the present invention may be considered to provide a multiwall bag used for shipping bulk material comprising an inner ply of kraft paper, an intermediate ply of thin perforated polyethylene secured to the inner ply, and an outer ply of kraft paper adhered to the intermediate ply, at least one of the ends of the bag being formed to close the at least one end of the bag.

The invention will be described in greater detail hereinafter with reference to the drawings.

BRIEF DESCRIPTION OF THE DRAWINGS

FIG. 3 is a plan view of a bag blank after the ends have been folded but before they have been secured to form the stepped bag ends.

FIG. 4 is a plan view of a completed multiwall bag of this invention.

DESCRIPTION OF THE PREFERRED EMBODIMENT

Figure 1:
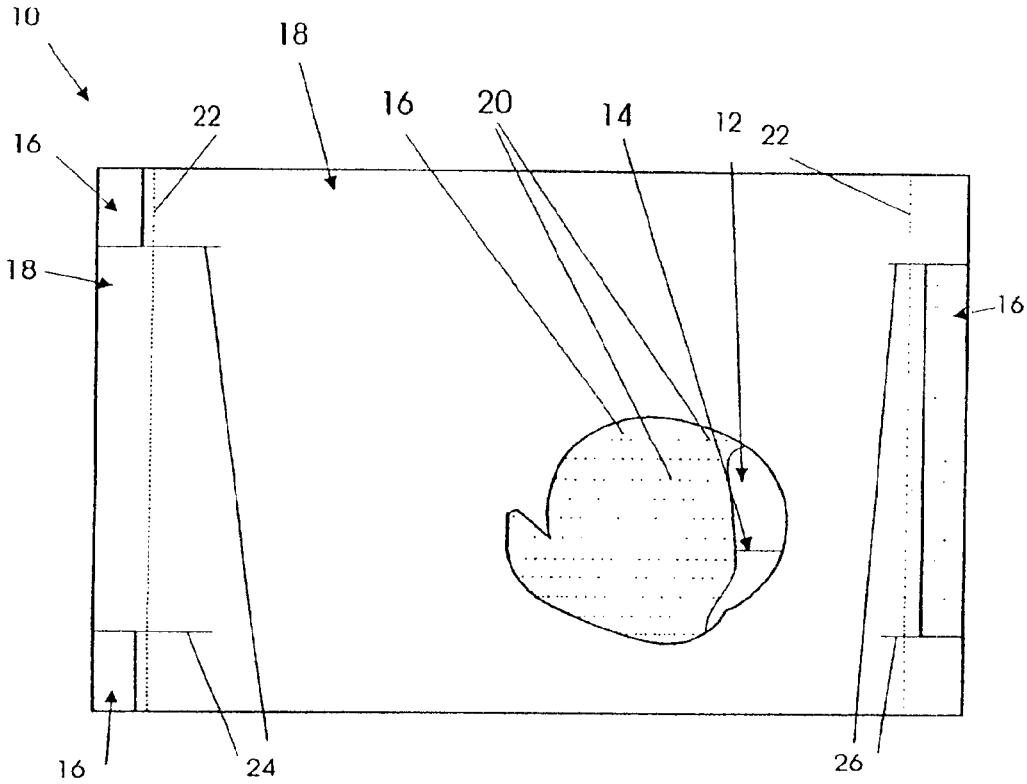
FIG. 1 shows a partially cut away bag blank illustrating the structure of the bag.

FIG. 1 shows a blank 10 for a multiwall bag in accordance with this invention. That blank shows that there is an inner ply 12 of kraft paper, preferably a high performance paper, which has been glued or otherwise formed along a longitudinal seam 14 into a tube of the desired length. Depending on the natural porosity of the kraft paper and the design of the bag with respect to the venting thereof the kraft paper of the inner ply 12 can be microperforated to improve the venting of air that is used during the filling of the bag, which air can be dissipated therethrough towards the atmosphere.

FIG. 1 also shows that the inner ply of the blank has an intermediate layer or ply 16 secured to the outer surface of the inner ply 12. The intermediate ply 16 is a perforated film of polyethylene. The intermediate ply can be as thin as 10 $\mu$m and should be formed of high density polyethylene (HDPE). This layer should be perforated to also allow air to be vented therethrough to and through the outer ply of the bag. The intermediate ply 16 can be microperforated or it can be provided with a plurality of micro slits as is known in the art.

The blank 10 includes an outer ply 18 of kraft paper which is secured to the intermediate ply 16. The outer ply 18 is also preferably a high performance paper which may be perforated or unperforated. An unperforated outer ply will help to ensure a clean filling process with powdery material. Additionally, an unperforated outer ply 18 would aid in reducing degradation of the ultimate strength of the bag.

Figure 2:
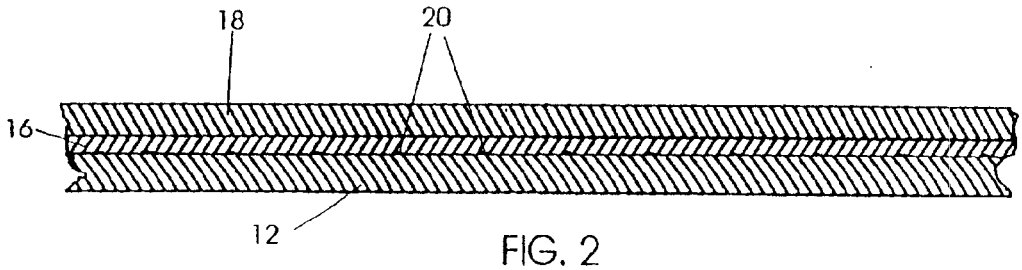
FIG. 2 shows an enlarged transverse section through a portion of a bag wall.

FIGS. 1 and 2 illustrate the manner in which the intermediate ply 16 is secured to the inner ply 12. There it is seen that a plurality of longitudinally extending securement lines 20 are spaced apart transversely of the bag blank. The intermediate ply 16 is preferably adhered to the inner ply 12 along the securement lines using a suitable adhesive. The end result is that there are lengths of the intermediate ply between adjacent securement lines that are not directly secured to the inner ply. Although not shown, the intermediate ply 16 could be adhered to the inner ply 12 through the application of a thin coating of adhesive over the entire surface of one or both of the mating surfaces of the intermediate and inner plies. Another lamination technique that could be used to adhere the intermediate ply to the inner ply is electrostatic lamination. This technique would maintain the intermediate and inner plies in full contact, with no relative movement therebetween, until the final construction of the bag is achieved.

The outer ply 18 is secured to the intermediate ply 16 by transverse lines of securement 22, one at each end of the bag blank 10 spaced inwardly from the end edges of the blank. Securement preferably can be achieved by way of a suitable adhesive.

The manufacturing process is fairly straightforward involving initial securement of the intermediate ply 16 to the outer surface of the inner ply 12. This can be accomplished continuously using indefinite lengths of roll stock of kraft paper and polyethylene film. The two plies pass through an adhesive applicator and presser section which applies lines of adhesive to the inner ply, brings the intermediate ply into contact with the lines of adhesive, and presses the two plies together as the adhesive sets. Preferably a suitable cold adhesive having a fast-setting property would be used as the adhesive, although a suitable hot-melt adhesive could also be used.

The outer ply 18 would then be brought into continuous contact with the moving web of inner and intermediate plies and would be secured to the intermediate ply along the spaced apart securement lines 22.

When the intermediate ply 16 is laid on the inner ply 12 it is offset slightly from one longitudinal edge of the inner ply 12 so that a narrow strip of the inner ply adjacent that one edge is not covered by the film of the intermediate ply. On the other hand the intermediate ply 16 extends beyond the other longitudinal edge of the inner ply 12 by a distance approximately equal to the width of the narrow uncovered strip adjacent the one edge. When the flat laminated web is folded into a tubular form a bead of glue will be applied along the narrow strip on the outer surface of the inner ply 12 for adhesive contact with the inner surface of the inner ply along the other longitudinal edge thereof to define an inner longitudinal seam of the finished bag. Once the web has been formed into its tubular shape the portion of the intermediate ply which extends beyond the other longitudinal edge of the inner ply will overly the adjacent section of the intermediate ply that extends along the narrow uncovered strip of the inner ply.

As seen in FIG. 1 short longitudinal slits 24, 26 are provided in the outer ply 18. These slits allow the bag ends to be formed after the blank has been severed from the continuous web of laminated paper and polyethylene film. FIG. 3 shows the bag ends after initial folding and prior to final closure. There it is seen that the end material has been folded flat onto one side surface of the bag and that central, generally triangular, flaps 28 have been folded inwardly from each edge. Generally rectangular flaps 30, 32, 34, 36 have been formed between the central flaps, outside of fold lines 38, 40, 42, 44 respectively. The flaps 30, 32, 34, 36 are slightly different from each other. The flap 32 has a section 46 of the outer ply 18 which stops short of the edge of section 48 of the inner ply 12 with intermediate ply 16 secured thereto (to the underside of the section 48 and hence not visible). The flap 36 has a section 50 of the outer ply 18 which stops short of the edge of section 52 of the inner ply 12 with intermediate ply 16 secured thereto (to the underside of the section 52 and hence not visible). The flap 30 on the other hand has a section 54 of the outer ply 18 which extends beyond the edge of section 56 of the inner ply 12 with intermediate ply 16 secured thereto (to the underside of the section 56 and hence not visible). The flap 34 has a section 58 of the outer ply 18 which extends beyond the edge of section 60 of the inner ply 12 with intermediate ply 16 secured thereto (to the underside of the section 60 and hence not visible).

To complete the bag, adhesive is applied as desired and the flaps 30, 32, 34, 36 are folded on the lines 38, 40, 42, 44 respectively to be brought into contact with the adhesive and held in such contact until the adhesive sets. At one end, adhesive is applied along the exposed portions of section 54 of the outer ply 12 of the flap 30. The flaps 32, 30 are folded about the fold lines 40, 38 respectively so that the flap 30 overlies the flap 32 and both overly the central flaps 28. Pressure is applied while the adhesive sets to cause sealing of the overlapping exposed portions of the intermediate ply 16 whereby the end of the bag is effectively sealed.

At the other end of the bag a line of adhesive is applied along the exposed portions of the section 58 of the outer ply 12 of the flap 34. The flaps 36, 34 are folded over about the fold lines 44, 46 respectively so that the flap 34 overlies the flap 36. Pressure is applied while the adhesive sets to effect sealing of the overlapping exposed portions of the intermediate ply 16. Because of the differences between the flaps 36 and 32 there will be no transverse sealing at the one of the central flaps 28 and consequently there will be a sleeve 62 defined between the central flap 28 and the overlapping flaps 36, 34 providing access to the interior of the bag for filling purposes.

The foregoing has described a bag having stepped ends and a valve sleeve in one end. The same invention could also be used with a bag which is initially formed with one closed end, the other end being left open. Once the bag has been filled, as by a gravity feed, the open end would be closed in a conventional manner, as for example by sewing.

The bag resulting from the foregoing process is light in weight, is relatively inexpensive to manufacture, and will allow air to pass from the interior of the bag during and after filling. While a preferred form of the bag of this invention has been described it is understood that variations thereto are within the realm of a skilled practitioner without departing from the spirit of the invention. The protection to be afforded the invention is to be determined from the scope of the claims appended hereto.

What is claimed is:

1. A multiwall bag used for shipping bulk material comprising an inner ply of kraft paper, an intermediate ply of thin microperforated polyethylene adhesively secured to said inner ply along a plurality of transversely spaced apart adhesive securement lines which extend longitudinally of the inner ply, leaving longitudinally extending non-adhered sections between adjacent adhesive lines, and an outer ply of kraft paper adhered to said intermediate ply along lines of adhesive extending transversely of the bag adjacent each end thereof, at least one of the ends of said bag being formed to close said at least one end.

2. The bag of claim 1 wherein both ends of said bag are closed, with one such end having a valve providing access to the interior of said bag.

3. The bag of claim 1 wherein said inner ply of kraft paper is microperforated.

4. The bag of claim 1 wherein said micro perforated intermediate ply contains a plurality of microslits therein.

5. The bag of claim 1 wherein said intermediate ply is formed from high density polyethylene (HDPE) having a minimum thickness of 10 $\mu$m.

6. The bag of claim 1 wherein each of said inner and outer plies is formed from high performance kraft paper.

* * * * *